US009339918B2

(12) United States Patent
Chang

(10) Patent No.: US 9,339,918 B2
(45) Date of Patent: May 17, 2016

(54) IDENTIFIABLE TOOL

(71) Applicant: Hsiu-Hua Chang, Taichung (TW)

(72) Inventor: Hsiu-Hua Chang, Taichung (TW)

( * ) Notice: Subject to any disclaimer, the term of this patent is extended or adjusted under 35 U.S.C. 154(b) by 236 days.

(21) Appl. No.: 14/102,558

(22) Filed: Dec. 11, 2013

(65) Prior Publication Data

US 2015/0158152 A1 Jun. 11, 2015

(51) Int. Cl.

| | |
|---|---|
| ***B25B 13/06*** | (2006.01) |
| ***B25B 15/00*** | (2006.01) |
| ***G09F 3/00*** | (2006.01) |
| ***B25B 13/56*** | (2006.01) |
| ***B25B 23/00*** | (2006.01) |

(52) U.S. Cl.
CPC ..... *B25B 13/06* (2013.01); *B25B 13/56* (2013.01); *B25B 15/001* (2013.01); *B25B 23/0021* (2013.01)

(58) Field of Classification Search
CPC ..... B25B 15/00; B25B 15/02; B25B 15/004; B25B 15/005; Y10S 81/05
USPC ..... 81/180.1, 438, 460, 461
See application file for complete search history.

(56) References Cited

U.S. PATENT DOCUMENTS

| | | | | |
|---|---|---|---|---|
| 1,984,839 | A * | 12/1934 | Murray | G09F 3/00 116/200 |
| 5,299,474 | A * | 4/1994 | Hohmann | B25B 23/1415 81/467 |
| 7,168,348 | B2 * | 1/2007 | Holland-Letz | B25B 15/005 81/436 |
| 8,418,587 | B2 * | 4/2013 | DeBaker | B25B 15/002 81/436 |
| 2009/0314142 | A1 * | 12/2009 | Huang | G09F 3/00 81/438 |

* cited by examiner

*Primary Examiner* — Hadi Shakeri

(57) ABSTRACT

An identifiable tool includes a bit and an identification ring. The bit includes a frusto-conical section formed on an external side. The identification ring includes an identification layer formed on an external side and a frusto-conical section formed on an internal side. The frusto-conical section of the identification ring is in contact with the frusto-conical section of the bit when the identification ring is placed on the bit.

7 Claims, 4 Drawing Sheets

IDENTIFIABLE TOOL

BACKGROUND OF INVENTION

1. Field of Invention

The present invention relates to a tool and, more particularly, to an identifiable tool.

2. Related Prior Art

There are hand tools, electric tools and pneumatic tools. Many of these tools are sold in tool kits. A tool kit includes a set of bits and a handle, an electric unit or a pneumatic unit for driving one of the bits. The bits may be screwdrivers, sockets or extension rods. There are various types and sizes of bits, causing a user trouble in getting a desired type and size of a bit.

To solve the foregoing problem, there have been attempts to facilitate the identification of the bits. To this end, the bits may be dyed or painted so that a color layer is made on each bit to represent the size of the bit. However, the color layer may be peeled from the bit so that the identification of is interrupted and the look of the bit is unpleasant.

As disclosed in Taiwanese Patent M341583, a bit 1 is formed with a recess 4. The recess 4 is filled with colorant to form a color layer 41 to represent the size of the bit 1. The area of the color layer 41 is limited by the area of the recess 4.

As disclosed in Taiwanese Patent M343559, a screwdriver is made with an annular groove 121. A pattern 121a is made in the bed of the annular groove 121 by pressing. Alternatively, a color layer 121b is formed on the bed of the annular groove by dying or painting. Alternatively, a color layer 121c is formed on the bed of the annular groove by electroplating. The area of the pattern 121a or the color layer 121b or 121c is limited by the area of the annular groove 121.

As disclosed in Taiwanese Patent M344226, a screwdriver 20 is made with an annular groove 21 to receive color rings 31 and 32. The color rings 31 and 32 together represent the size of the screwdriver 20.

Therefore, the present invention is intended to obviate or at least alleviate the problems encountered in prior art.

SUMMARY OF INVENTION

It is the primary objective of the present invention to provide an identifiable tool.

To achieve the foregoing objective, the identifiable tool includes a bit and an identification ring. The bit includes a frusto-conical section formed on an external side. The identification ring includes an identification layer formed on an external side and a frusto-conical section formed on an internal side. The frusto-conical section of the identification ring is in contact with the frusto-conical section of the bit when the identification ring is placed on the bit.

Other objectives, advantages and features of the present invention will be apparent from the following description referring to the attached drawings.

BRIEF DESCRIPTION OF DRAWINGS

The present invention will be described via detailed illustration of three embodiments referring to the drawings wherein.

DETAILED DESCRIPTION OF EMBODIMENTS

Figure 1:
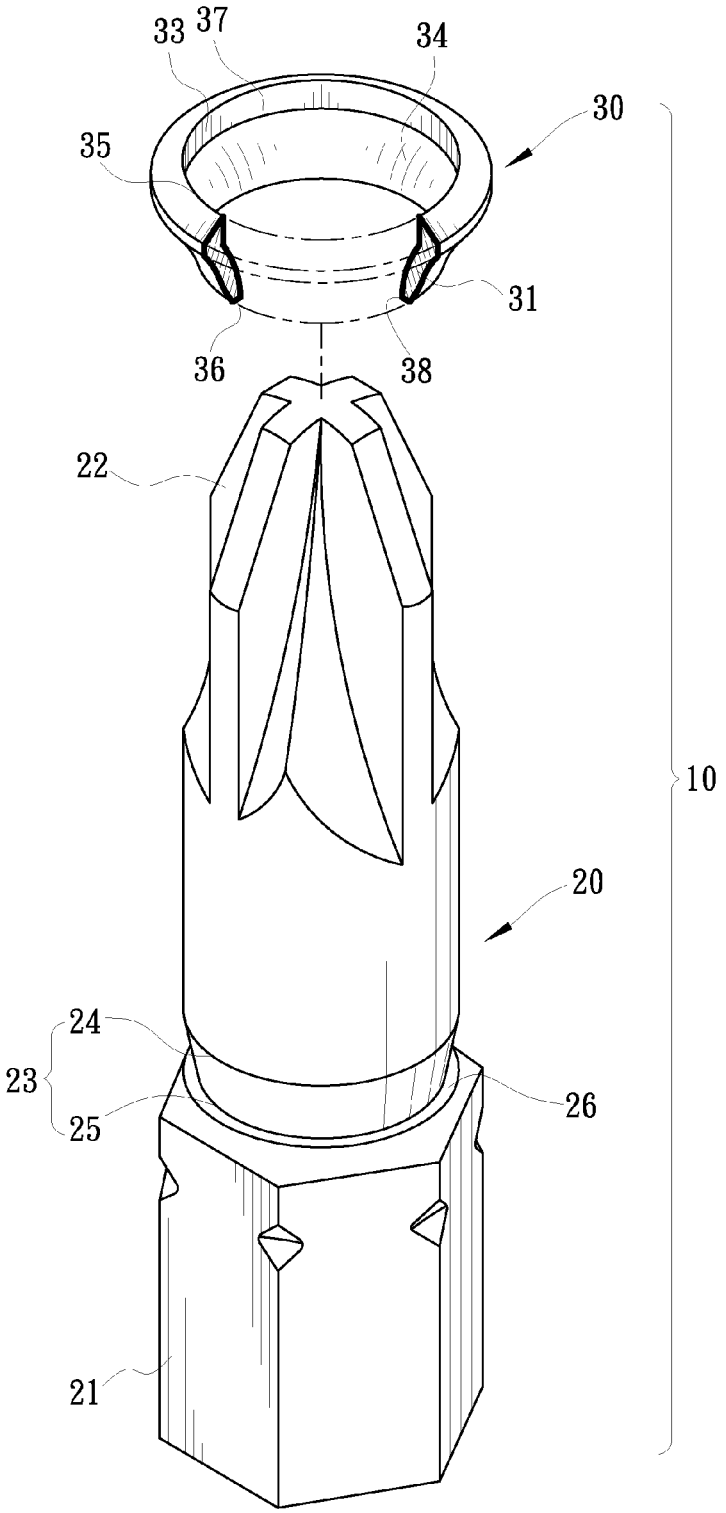
FIG. 1 is an exploded view of an identifiable tool according to the first embodiment of the present invention.
Figure 2:
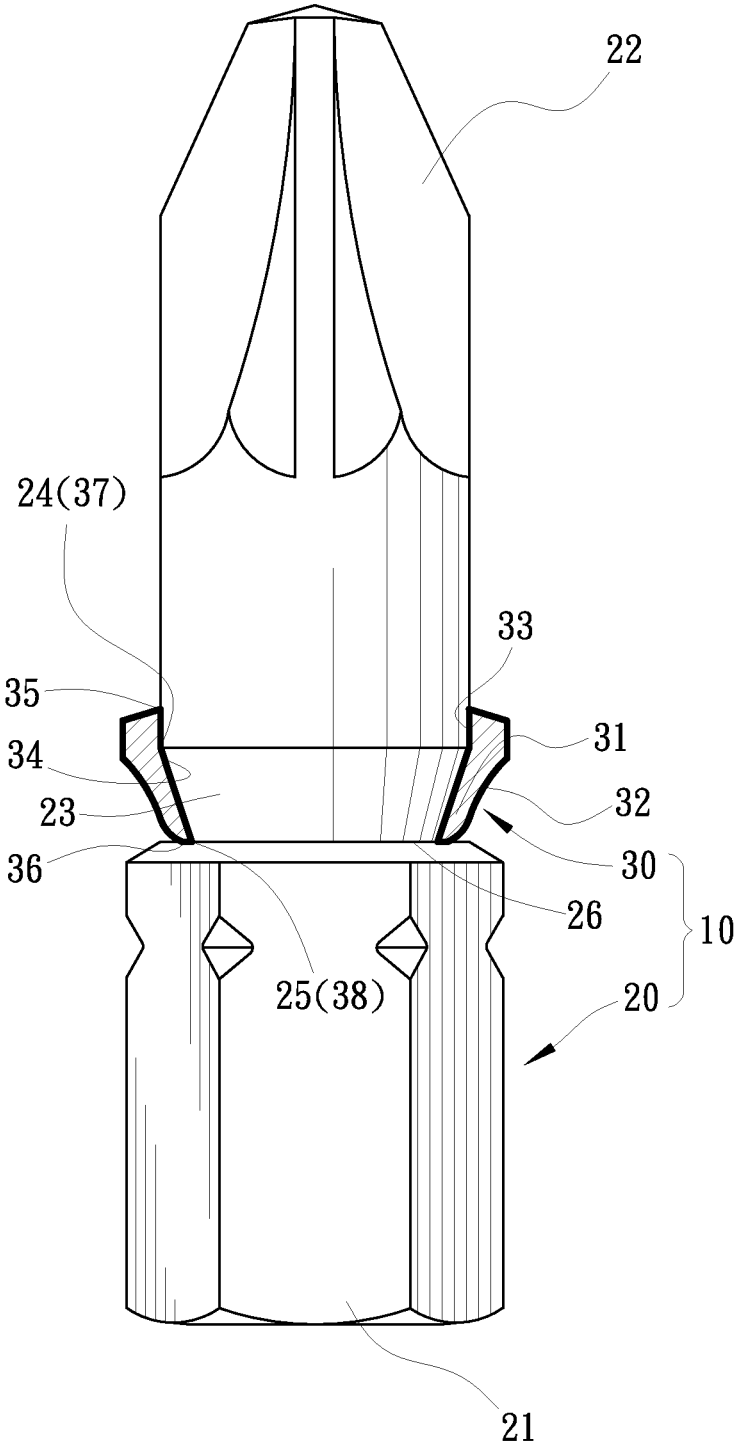
FIG. 2 is a cross-sectional view of the an identifiable tool shown in FIG. 1.

Referring to FIGS. 1 and 2, there is an identifiable tool 10 according to a first embodiment of the present invention. The identifiable tool 10 includes a bit 20 and an identification element 30.

The bit 20 is a bit of a screwdriver in the first embodiment. The bit includes a first terminal section 21, a second terminal section 22 and a middle section 23 formed between the first and second terminal sections 21 and 22. The middle section 23 is in the shape of a conical frustum. The bit 20 further includes an annular planar face 26 between the first terminal section 21 and the middle section 23.

The first terminal section 21 of the bit 20 is a hexagonal section. The first terminal section 21 of the bit 20 can be inserted in a compliant recess (not numbered) made in a hand tool, an electric tool or a pneumatic tool. Thus, bit 20 can be rotated by the hand tool, an electric tool or a pneumatic tool.

The second terminal section 22 of the bit 20 is formed with a circular shank and a cruciform tip. The cruciform tip of the second terminal section 22 of the bit 20 can be inserted in a compliant recess made in a screw for example. Thus, the screw can be rotated by the bit 20.

The middle section 23 of the bit 20 includes a small end 25 near the first terminal section 21 of the bit 20 and a large end 24 near the second terminal section 22 of the bit 20.

The annular planar face 26 includes an internal edge and an external edge. The internal edge of the annular planar face 26 extends around the small end 25 of the middle section 23 of the bit 20. There is a sharp angle between the middle section 23 of the bit 20 and the annular planar face 26.

The identification element 30 is formed with an upper end 35 and a lower end 37. An identification layer 32 is provided on an external side of the identification element 30 by anodizing. The identification layer 32 carries at least one color to represent the specification and/or size of the bit 20. The identification element 30 includes, on an internal side, an annular face 33 formed near the upper end 35 of the identification element 30 and a frusto-conical face 34 formed near the lower end 36 of the identification element 30. The annular face 33 of the internal side of the identification element 30 is compliant to the second terminal section 22 of the bit 20. The frusto-conical face 34 of the internal side of the identification element 30 is compliant to the middle section 23 of the bit 20. The identification element 30 can be an O-ring or a C-clip.

The identification element 30 is placed around the bit 20. The annular face 33 of the internal side of the identification element 30 is in contact with the second terminal section 22 of the bit 20. The frusto-conical face 34 of the internal side of the identification element 30 is in contact with the middle section 23 of the bit 20.

Figure 3:
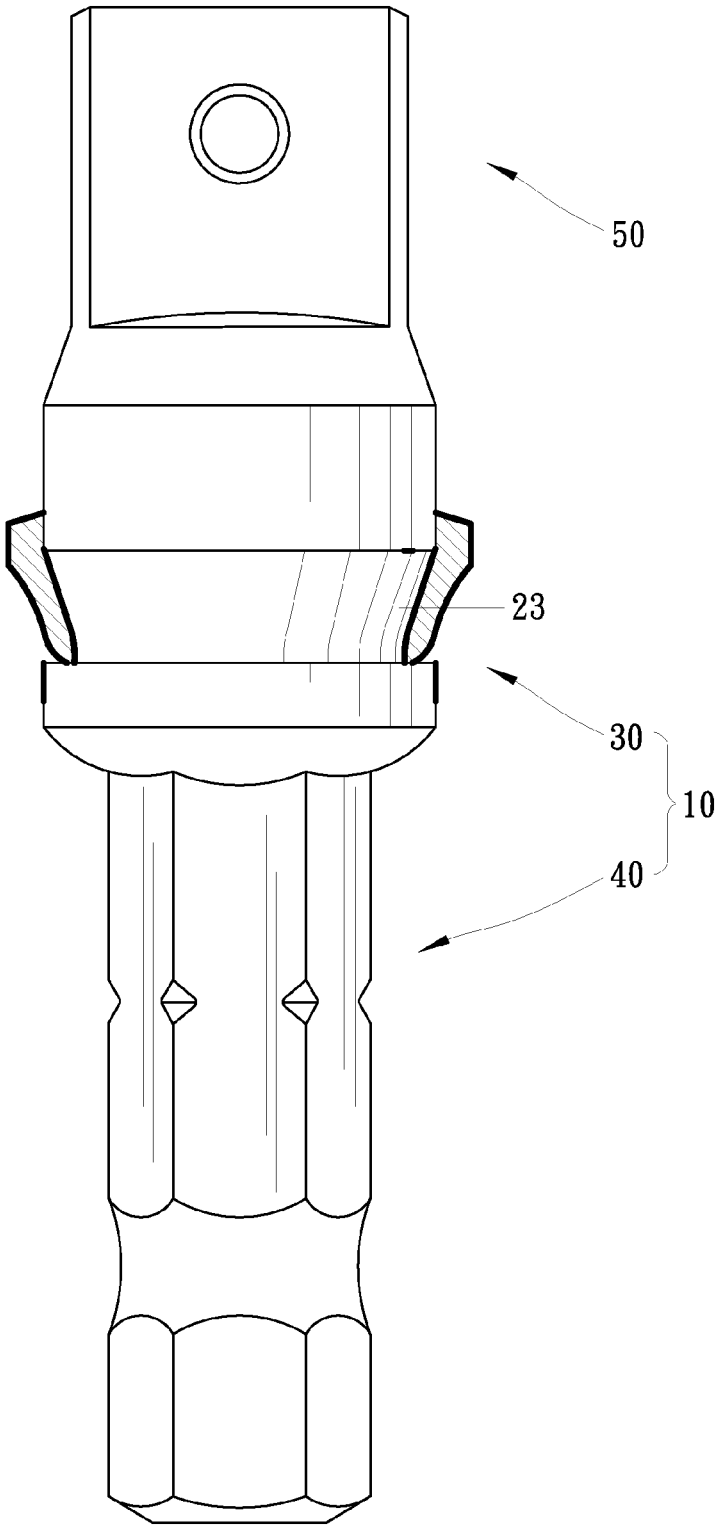
FIG. 3 is a cross-sectional view of an identifiable tool according to the second embodiment of the present invention.

Referring to FIG. 3, there is an identifiable tool according to a second embodiment of the present invention. The second embodiment is identical to the first embodiment except that the bit 20 includes two terminal sections 40 and 50 instead of the terminal sections 21 and 22, respectively. The first terminal section 40 is identical to the first terminal section 21 except extending longer and including an annular groove. The second terminal section 50 is a square section.

Figure 4:
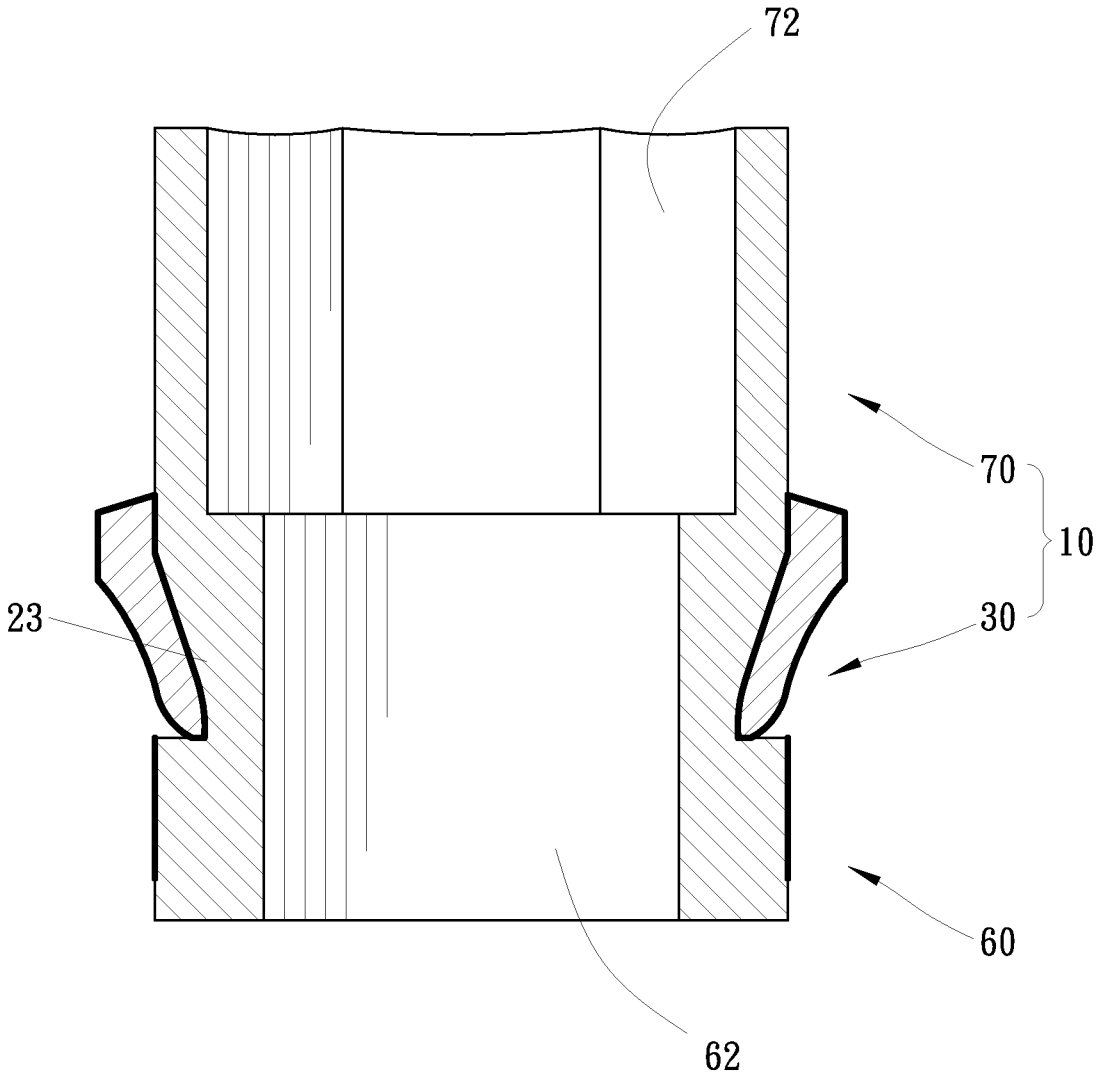
FIG. 4 is a cross-sectional view of an identifiable tool according to the third embodiment of the present invention.

Referring to FIG. 4, there is an identifiable tool according to a third embodiment of the present invention. The third embodiment is identical to the first embodiment except that the bit 20 includes two terminal sections 60 and 70 instead of the terminal sections 21 and 22, respectively. The first terminal section 60 includes a square recess 62. The second terminal section 70 includes a hexagonal recess 72.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. An identifiable tool including:

a bit including a first terminal section for operable coupling to a driving tool, a second terminal section for rotating a fastener, and a frusto-conical section formed on an external side and formed with a small end near the first terminal section and a large end near the second terminal section; and an identification element including:

an identification layer formed on an external side;

a frusto-conical face formed on an internal side, wherein the frusto-conical face of the identification element is in contact with the frusto-conical section of the bit when the identification element is placed on the bit, wherein the frusto-conical face of the bit identification element comprises a small end placed at the small end of the conical section of the bit and a large end placed at the large end of the frusto-conical section of the bit; and an annular face next to the large end of the frusto-conical face and in contact with the second terminal section of the bit.

2. The identifiable tool according to claim 1, wherein the bit includes an annular planar face formed between the first terminal section and the frusto-conical section, wherein there is a sharp angle between the annular planar face and the frusto-conical section.

3. The identifiable tool according to claim 1, wherein the second terminal section of the bit is formed with a cruciform tip.

4. The identifiable tool according to claim 1, wherein the second terminal section of the bit is a square section.

5. The identifiable tool according to claim 1, wherein the second terminal section of the bit is formed with hexagonal recess.

6. The identifiable tool according to claim 1, wherein the identification element is an O-ring.

7. The identifiable tool according to claim 1, wherein the identification element is a C-clip.

* * * * *